US006928963B2

(12) United States Patent
Karanik

(10) Patent No.: US 6,928,963 B2
(45) Date of Patent: Aug. 16, 2005

(54) LOW DRAG FAN FOR A RAM AIR INDUCTION SYSTEM

(75) Inventor: James J. Karanik, Brookhaven, NY (US)

(73) Assignee: Northrop Grumman Corporatin, Los Angeles, CA (US)

( * ) Notice: Subject to any disclaimer, the term of this patent is extended or adjusted under 35 U.S.C. 154(b) by 74 days.

(21) Appl. No.: 10/721,625

(22) Filed: Nov. 25, 2003

(65) Prior Publication Data

US 2005/0109291 A1 May 26, 2005

(51) Int. Cl.[7] ..... F01P 7/02
(52) U.S. Cl. ..... 123/41.63; 123/41.65
(58) Field of Search ..... 123/41.63, 41.65; 416/12, 16, 142

(56) References Cited

U.S. PATENT DOCUMENTS

| | | | | |
|---|---|---|---|---|
| 1,728,768 | A | 9/1929 | O'Connor | |
| 3,561,883 | A | 2/1971 | Berry | |
| 3,957,229 | A | 5/1976 | Davis | |
| 4,394,109 | A | 7/1983 | Ritchie | |
| 4,427,341 | A | 1/1984 | Eichler | |
| 4,776,761 | A | 10/1988 | Diaz | |
| 4,936,526 | A | 6/1990 | Gries | |
| 4,979,876 | A | 12/1990 | Chapman | |
| 6,070,560 | A * | 6/2000 | Johnston et al. | 123/41.11 |
| 6,161,994 | A | 12/2000 | Lang | |
| 6,321,830 | B1 * | 11/2001 | Steinmann | 165/41 |
| 6,543,523 | B2 * | 4/2003 | Hasumi | 165/125 |
| 6,604,360 | B1 * | 8/2003 | Vuk | 60/597 |
| 6,751,946 | B2 * | 6/2004 | Li | 60/269 |
| 2004/0101406 | A1 * | 5/2004 | Hoover | |

* cited by examiner

*Primary Examiner*—Henry C. Yuen
*Assistant Examiner*—J A Benton
(74) *Attorney, Agent, or Firm*—Stetina Brunda Garred & Brucker

(57) ABSTRACT

A low drag fan assembly is provided which is adapted to be mounted within a ducting conduit of a ram air induction system of a vehicle for cooling a heat exchanger. The assembly includes a motor having an output drive; a motor bracketing system attached to the motor for suspending the motor within the ducting conduit; a fan hub attached to the output drive; and a plurality of foldable fan blades hingedly attached to an outer perimeter of the fan hub. When the motor is not activated, the plurality of fan blades are folded back in a non-deployed state which is generally longitudinally congruent to the airflow within the ducting conduit. When the motor is activated, the plurality of fan blades radially extend to a deployed state generally normal to and transverse to the airflow within the ducting conduit.

17 Claims, 3 Drawing Sheets

LOW DRAG FAN FOR A RAM AIR INDUCTION SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention relates to low drag, collapsible or foldable fan systems. In particular, the present invention relates to a fan having foldable blades adapted to be positioned in ducting conduit of a ram air induction system on a vehicle such as an aircraft, spacecraft, ocean vessel, land conveyance vehicle or the like.

2. Background of the Invention

In many vehicles, airflow is often utilized as a cooling medium to chill coolants that are circulated through a heat exchanger. In particular, many vehicles utilize ram air induction systems to capture air as a function of the movement of the vehicle, and to channel the air through ducting conduits which lead to a heat exchanger. If the ram air induction is designed properly, when the vehicle is in motion, sufficient airflow is provided to the heat exchanger by the ram action of the air as the vehicle travels through an air medium.

An inherent characteristic and disadvantage with ram air induction systems is that optimal airflow, which is essential for optimal cooling, is usually directly proportional to vehicle speed or velocity. Therefore, when the vehicle is not moving, minimal airflow is delivered to the heat exchanger which significantly reduces the cooling efficiency of the heat exchanger.

While many vehicle cooling requirements are easily satisfied by ram air induction systems, other vehicles require "ground cooling". For instance, when a vehicle is powered-up and yet still stationary, many systems of a vehicle may be creating heat which require cooling. If the vehicle is supporting a mission in which no travel is required, ground support equipment (GSE) may be connected to or tapped into the cooling lines of the vehicle to provide chilled coolant. However, if the vehicle mission ultimately requires travel, there is inherently is a transitory period either before and/or after the mission (e.g., prior or after take-off for an aircraft), or even during a mission, in which the vehicle is not in motion or is not traveling fast enough to receive the benefits of ram air. Furthermore, in this transitory period GSE is not viable to support ground cooling since the vehicle ultimately has to travel to accomplish the mission.

To overcome this disadvantage, an auxiliary fan may be placed internally within the ducting conduit of the ram air induction system to provide enough airflow to the heat exchanger for proper cooling operation. In this scenario, the fan is usually turned off when sufficient ram inducted airflow is delivered to the heat exchanger as indicated by instrumentation which shows proper cooling. However, this approach has it own disadvantage. In particular, since the fan blades are static while the motor is deactivated, a pressure drop that is detrimental to optimal heat exchanger design and/or operation is created between the backside of the fan blades and entrance side of the heat exchanger.

It is proposed that a low drag fan assembly having foldable fan blades be utilized as the auxiliary fan positioned within the ducting conduit of the ram air induction system to overcome these known disadvantages. With this arrangement, the fan blades may be folded or collapsed back while the vehicle is in motion and receiving sufficient ram air. As a result, the airflow obstruction created by the static fan blades is substantially reduced.

A review of the prior art reveals that there are no known apparatuses or systems currently available which are designed to provide sufficient airflow to a heat exchanger positioned within a ducting conduit of a ram air induction system. For example, U.S. Pat. No. 1,728,768 to O'Connor teaches a ventilation device capable of permitting either forced or natural flow of air through a conduit. However, even though O'Connor teaches positioning a fan with folding fan blades within a conduit, the O'Connor system is not a ram air induction system for a vehicle which utilizes a heat exchanger. In other words, the O'Connor is specifically designed to handle either fan forced or natural flowing air, not ram air created from movement of the vehicle.

Other prior art examples include the use of folding fan blades in turbines, turbo fans, or turboprop propulsion systems (see U.S. Pat. No. 3,957,229 to Davis, U.S. Pat. No. 4,394,109 to Ritchie, and U.S. Pat. No. 4,936,526 to Gries), however, these prior art references only teach the concept of folding fans. Furthermore, the aforementioned prior art is related to propulsion systems, not cooling systems. Further, other prior art references teach foldable fan blades (see U.S. Pat. No. 4,776,761 to Diaz and U.S. Pat. No. 6,161,994 to Lang), however, these references are not related to ram air induction systems.

It would be desirable to provide a low drag fan assembly which may be utilized as the auxiliary fan positioned within the ducting conduit of a ram air induction system. In particular, it would be beneficial to provide a system in which the fan blades may be folded back or collapsed while the vehicle is in motion and receiving sufficient ram air, such that the low pressure pocket created by static fan blades may be substantially reduced.

BRIEF SUMMARY OF THE INVENTION

The present invention provides a low drag fan assembly which may be utilized as an auxiliary fan positioned within a ducting conduit of a ram air induction system on a vehicle such as an aircraft, spacecraft, ocean vessel, land conveyance vehicle or the like. In particular, the present invention provides a system in which the fan blades may be folded back or collapsed while the vehicle is in motion and receiving sufficient ram air, such that the low pressure pocket created by static fan blades may be substantially reduced. In the preferred embodiment, a plurality of fan blades are rotatably hinged to the perimeter of a fan hub attached to the motor. The plurality of blades are spring loaded to fold back on the motor in a non-deployed state when the motor is not in operation. When the motor is activated, and the centrifugal force from the rotation of the motor exerted on the plurality of fan blades overcomes the force of the spring, the plurality of fan blades extend radially outward to a deployed state. Additionally, while the low drag fan is in operation, the plurality of fan blades are adapted to also fold back in the non-deployed state when the force applied normal to the plurality of fan blades created by the incoming ram air exceeds the centrifugal force exerted on the plurality of fan blades by the rotation of the motor. By utilizing the low drag fan assembly within a ducting conduit of a ram air induction system of a vehicle, the pressure drop between the back of the plurality of deployed fan blades and the entrance of the heat exchanger, may be substantially removed.

According to an exemplary embodiment of the present invention, a low drag fan assembly is provided which is adapted to be mounted within a ducting conduit of ram air induction system of a vehicle for cooling a heat exchanger. The low drag fan assembly includes a motor having an output drive; a motor bracketing system attached to the motor for suspending the motor within the ducting conduit of the ram air induction system; a fan hub attached to the output drive; and a plurality of foldable fan blades attached to an outer perimeter of the fan hub. When the motor is not activated, the plurality of fan blades are folded back in a non-deployed state which is in a generally longitudinally congruent orientation within the ducting conduit of the ram air induction system. When the motor is activated, the plurality of fan blades extend to a deployed state in which the plurality of blades are transversely oriented and normal to the flow path direction with the ducting conduit of the ram air induction system.

According to an aspect of the present invention, when the motor is inactive, the plurality of fan blades are held in the non-deployed state by a force from a spring. According to another aspect of the present invention, when the motor is activated, the plurality of fan blades extend to the deployed state when a centrifugal force imparted on the plurality of fan blades by the rotation of the motor exceeds the spring force which holds the plurality of fan blades in the non-deployed state. According to still another aspect of the present invention, when the force exerted on the plurality of fan blades by the airflow exceeds the centrifugal force imparted on the plurality of fan blades, the plurality of fan blades fold back to the non-deployed state.

According to another aspect of the present invention, each of the plurality of fan blades is attached to the fan hub by a foldable hinge. According to other aspects of the present invention, the foldable hinge provides a mechanical stop which engages a portion of the fan blade when the fan blade is extended to a fully-deployed position. According to a further aspect of the present invention, a pitch of the plurality of fan blades assists in extending the plurality of fan blades to the fully-deployed state.

According to another exemplary embodiment of the present invention, a low drag fan assembly in combination with a ram air induction system of a vehicle for cooling a heat exchanger is provided. The exemplary embodiment includes a ram air induction system having a ducting conduit with a centerline axis. It further includes a low drag fan assembly comprising a motor having an output drive; a motor bracketing system attached to the motor for suspending the motor within the ducting conduit; a fan hub attached to the output drive; and a plurality of foldable fan blades attached to an outer perimeter of the fan hub. When the motor is not activated, the plurality of fan blades are folded back in a non-deployed state which is generally longitudinally congruent to the centerline axis. When the motor is activated, the plurality of fan blades extend to a deployed state generally normal to the centerline axis.

According to another aspect of the present invention, a heat exchanger is transversely positioned within the ducting conduit of the ram air induction system beyond the low drag fan assembly. According to yet another aspect of the present invention, when the motor is inactive, the plurality of fan blades are held in the non-deployed state by a spring force.

In another aspect of the present invention, when the motor is activated, the fan hub and the plurality of fans rotate about the centerline axis. According to still yet another aspect of the present invention, the plurality of fan blades extend to the deployed state when a centrifugal force is imparted on the plurality of fan blades which exceeds the spring force that holds the plurality of fan blades in the non-deployed state. According to yet another aspect of the present invention, when the force exerted on the plurality of fans blades by the airflow exceeds the centrifugal force imparted on the plurality of fan blades, the plurality of fan blades fold back to the non-deployed state.

Additionally, according to another aspect of the present invention, each of the plurality of fan blades is attached to the fan hub by a foldable hinge. Moreover, according to another aspect of the present invention, the foldable hinge provides a mechanical stop which engages a portion of the fan blade when the fan blade is extended to a fully-deployed position. Furthermore, according to still yet another aspect of the present invention, a pitch of the plurality of fan blades assists in extending the plurality of fan blades to the fully-deployed state. Also, according to another aspect of the present invention, the vehicle may be an aircraft, spacecraft, ocean vessel, land conveyance vehicle or any other vehicle which utilizes a ram air induction system.

Other exemplary embodiments and advantages of the present invention may be ascertained by reviewing the present disclosure and the accompanying drawings.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which.

DETAILED DESCRIPTION OF THE INVENTION

It is initially noted that the exemplary embodiment described herein is presented in a simplified schematic manner. The particulars shown herein are by way of example and for purposes of illustrative discussion of one of many possible embodiments of the present invention and are presented in the cause of providing what is believed to be the most useful and readily understood description of the principles and conceptual aspects of the present invention. In this regard, no attempt is made to show structural details of the present invention in more detail than is necessary for the fundamental understanding of the present invention. The description in view of the drawings makes apparent to those skilled in the art how the several forms of the present invention may be embodied in practice.

Overview of an Exemplary Low Drag Fan Assembly

Figure 1:
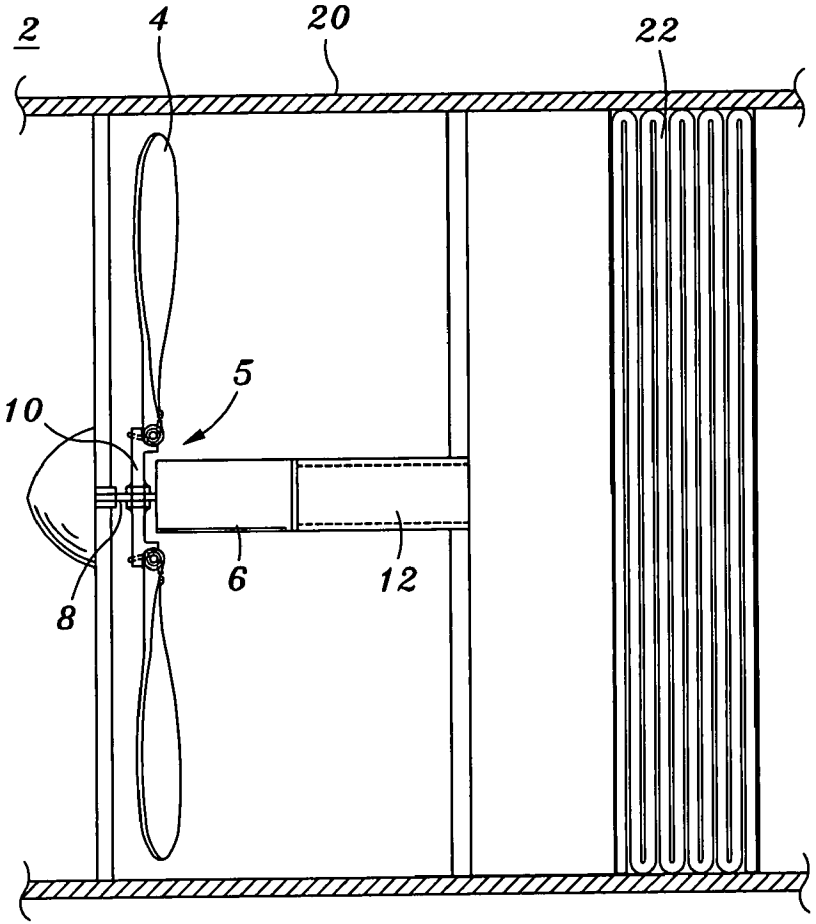
FIG. 1 is a side view of an exemplary embodiment of the low drag fan assembly with the fan blades deployed, according to an aspect of the present invention.
Figure 2:
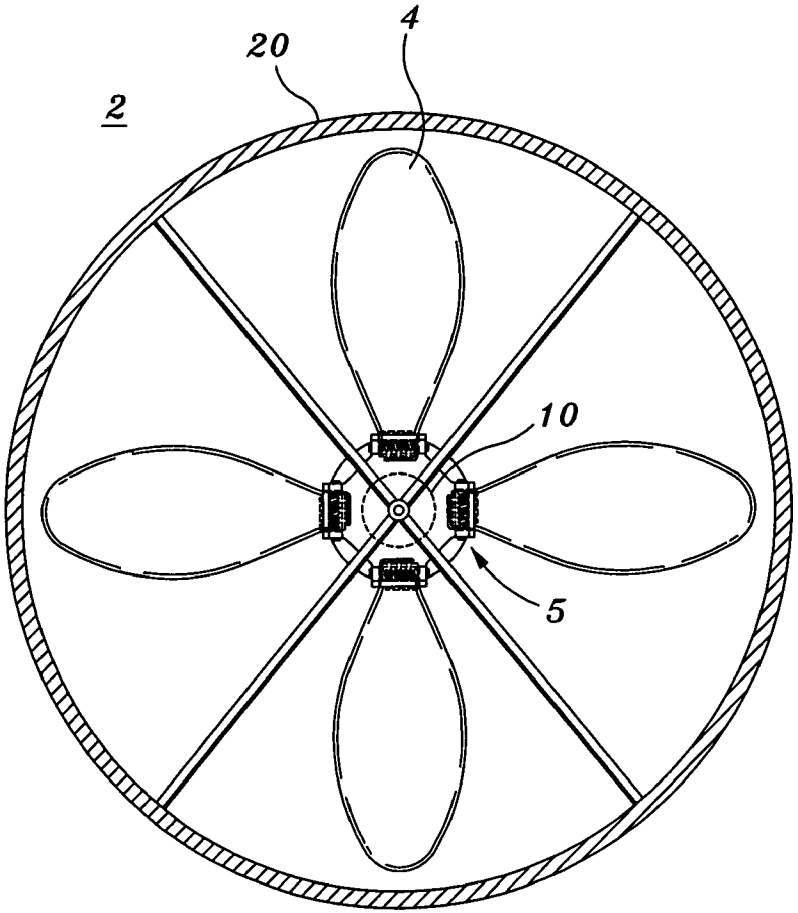
FIG. 2 is a front view of an exemplary embodiment of a low drag fan assembly with the fan blades deployed, according to an aspect of the present invention.
Figure 3:
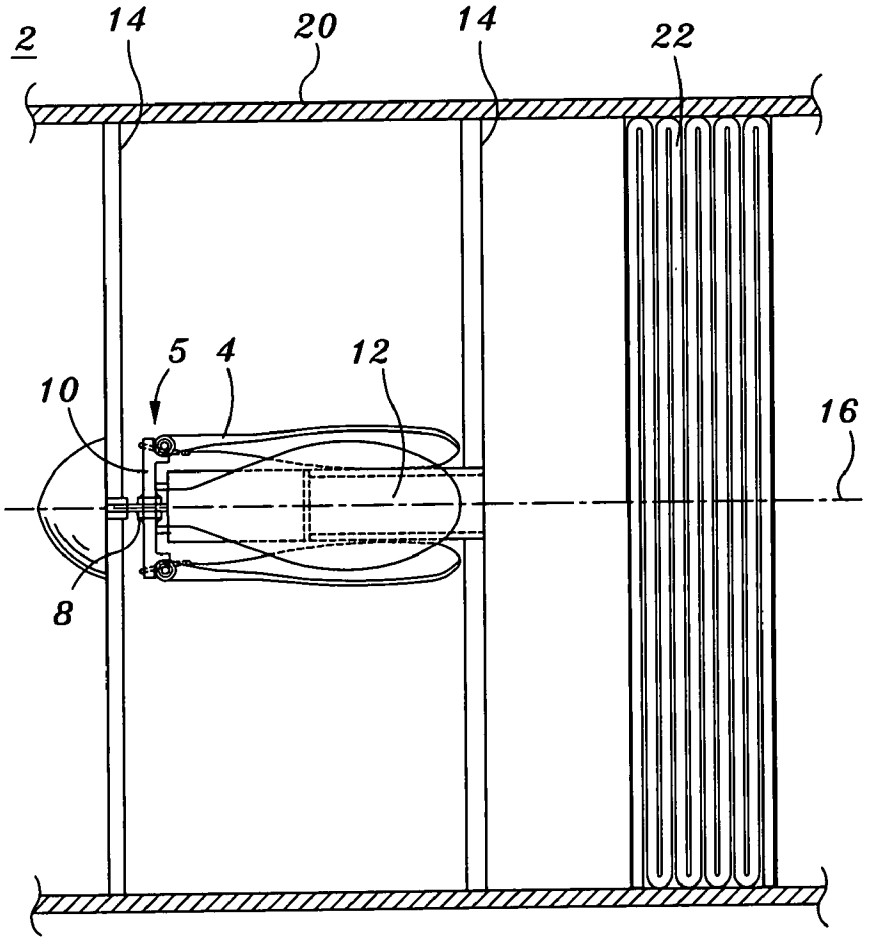
FIG. 3 is a side view of the exemplary embodiment of the low drag fan assembly with the fan blades folded back in a non-deployed state, according to an aspect of the present invention.
Figure 4:
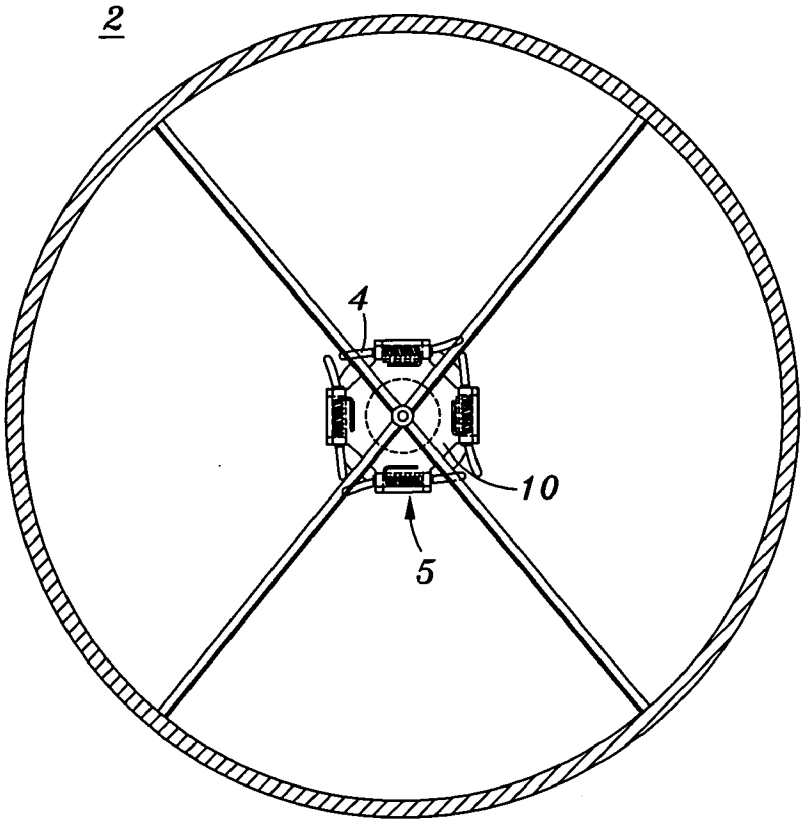
FIG. 4 is a front view of the exemplary embodiment of the low drag fan assembly with the fan blades folded back in a non-deployed state, according to an aspect of the present invention.

According to an exemplary embodiment of the present invention, a low drag fan assembly 2 is provided which is adapted to be installed within a ducting conduit of a ram air induction system of a vehicle. The low drag fan assembly 2 includes a motor 6, a plurality of foldable fan blades 4 attached to a fan hub 10, and bracketing 12, 14 to support the assembly 2 internally within a ducting conduit 20 of ram air induction system. FIG. 1 is a side view and FIG. 2 is a front view of the exemplary embodiment of the low drag fan assembly 2 with the fan blades 4 fully deployed, according to an aspect of the present invention. FIG. 3 is a side view and FIG. 4 is a front view of the exemplary embodiment of the low drag fan assembly 2 with the fan blades 4 folded back or collpased in a non-deployed state, according to an aspect of the present invention. The aforementioned components and others will be described in greater detail below.

Detailed Description of the Exemplary Low Drag Fan Assembly

The motor 2 is preferably an electrically powered unit which has an armature/drive shaft 8 centered about centerline axis 16. A variety of electric motors known in the art may be utilized in the present invention depending on the application's specific requirements. The motor 2 is positioned within the ducting conduit 20 of the ram air induction system utilizing any form of bracketing 12, 14 known in the art. The exemplary embodiment utilizes motor mount or bracket 12 coupled to a rear portion of the motor 2. The motor 2 and motor mount 12 are then positioned within the ducting conduit 20 utilizing a plurality of radial supports 14 which are attached to the internal surface of the ducting conduit 20. The forward end of the motor 2 may also be supported by a plurality of radial supports 14. In the exemplary embodiment, an external end of drive shaft 8 is rotatably retained within a drive shaft bearing journal 26 (see FIG. 6). The plurality of radial supports 14 are then positioned such that they interconnect the internal surface of the ducting conduit 20 to the outer surface of the drive shaft bearing journal 26. The centerline axis 16 is preferably located in a center of the ducting conduit 20.

Each of the plurality of foldable fan blades 4 are rotatably attached to a fan hub 10 utilizing a foldable hinge 5 such that they capable of folding from the non-deployed state to a deployed state. An exemplary fan hub 10 may have a mounting journal 28 (see FIG. 6) which is adapted to be rigidly fastened to the motor drive shaft 8. The fan hub 10 further includes a plurality of mounting yokes 32 for each respective fan blade 4. A securing pin 30 spans across the yoke 32 about a foldable hinge axis 36. Each fan blade 4 has a wrist 38 with a receiving hole 40 which is adapted to be rotatably secured by the securing pin 30 allowing the fan blade 4 to rotate about hinge axis 36 (see FIG. 5) from a deployed position as shown in FIGS. 1 and 2, to a non-deployed or folded back position as depicted in FIGS. 3 and 4.

Figure 6:
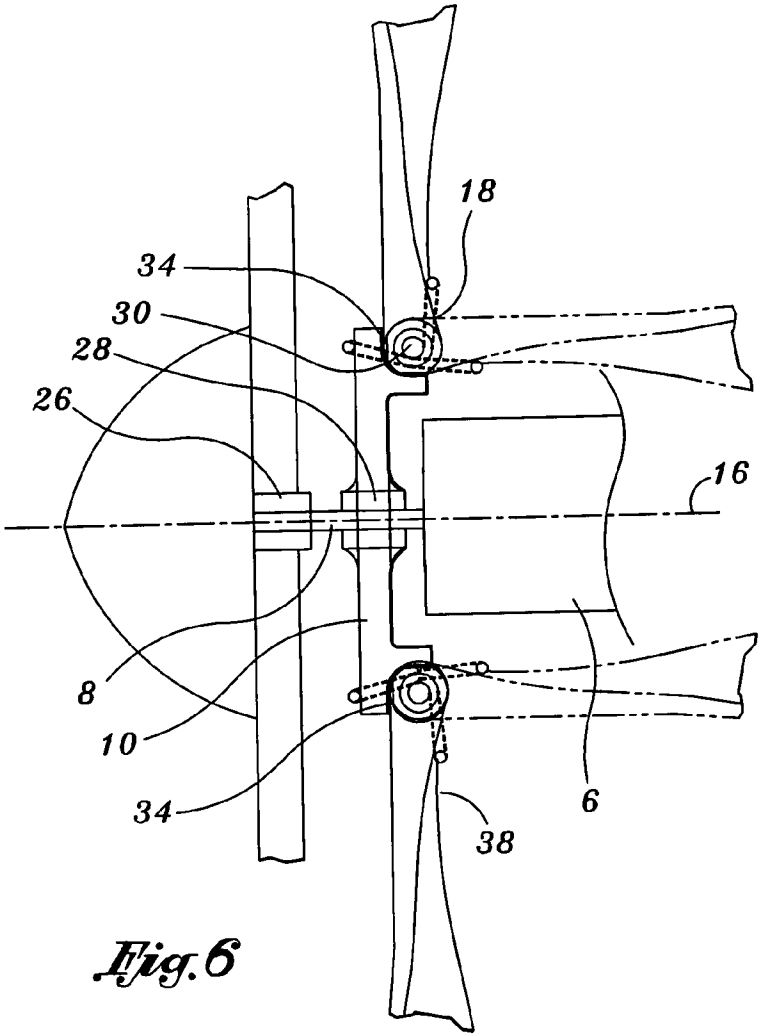
FIG. 6 is a side view of the fan hub of the exemplary embodiment of the low drag fan assembly, according to an aspect of the present invention.
Figure 5:
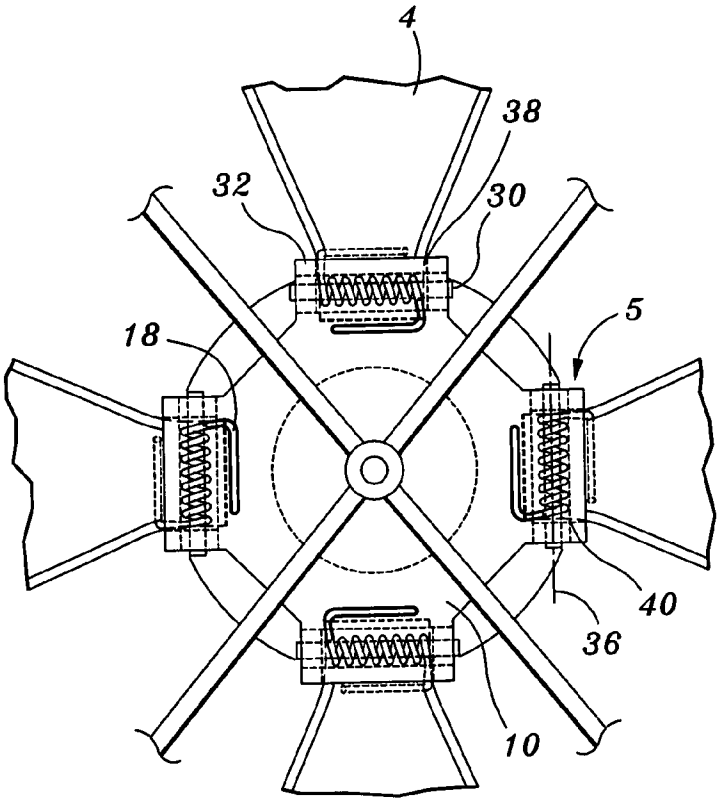
FIG. 5 is a front detail view of the fan hub of the exemplary embodiment of the low drag fan assembly, according to an aspect of the present invention.

FIG. 5 is a front detail view and FIG. 6 is a side view of the fan hub 10 of the exemplary embodiment of the low drag fan assembly 2, according to an aspect of the present invention. A spring 18 may be integrated into the foldable hinge 5 to maintain the fan blades 4 in a non-deployed state when the motor 6 in not operating. It is noted that the exemplary manner in which the spring 18 is incorporated into the foldable hinge 5 is merely one example of utilizing a spring to bias or force the fan blades 4 into the non-deployed state. In the exemplary embodiment, the securing pin 30 may be disposed concentrically within the spring 18 such that both the securing pin 30 and spring 18 are contained within the receiving hole 40. One leg of the spring 18 presses against a portion of the fan blade 4 proximate the fan blade wrist 38. The other end of the spring 18 presses against the exterior face of the fan hub 10. Preferably, when the spring 18 is biased open, the fan blade 4 is forced in the non-deployed state as illustrated in FIGS. 3 and 4. When a centrifugal force is exerted on the fan blade 4 from the motor 6, the legs of spring 18 are forced closed such that the fan blade 4 extends into the deployed state as illustrated in FIGS. 1 and 2.

Functionality of the Exemplary Low Drag Fan Assembly

As previously discussed, the plurality fan blades 4 of the low drag fan assembly 2 are adapted to fold into a deployed state (see FIGS. 1 and 2) and a non-deployed state (see FIGS. 3 and 4). The following section discusses the dynamics of the aforementioned. When a vehicle having a ram air induction system is not moving, no air is forced through the ducting conduit 20. Thus, if the idle vehicle requires cooling through the heat exchanger 22 positioned within the ducting conduit 20, then the low drag fan assembly 2 may be operated to provide airflow to the heat exchanger 22. Typically, while the vehicle is idle, the motor 6 may be then be activated to force airflow through heat exchanger 22. When the motor 6 reaches it normal operating speed (RPMs), the centrifugal force exerted on the plurality of fans blades 4 is sufficient to overcome the spring force applied to the fan blade wrist 38 such that the legs of the spring 18 are compressed. Furthermore, the pitch of the fan blades 4 is designed such that the fan blades 4 will dynamically pull themselves to a deployed state which is generally perpendicular and transverse to the centerline axis 16 of the low drag fan assembly 2. The plurality of blades 4 extend outward towards the perpendicular positioned until a portion of the fan blade wrist 38 engages a mechanical stopping surface 34 (see FIG. 6) disposed on the fan hub 10 in the foldable hinge 5. In this position, the low drag fan assembly 2 operates as a conventional fan providing airflow to the heat exchanger 22.

When the vehicle is moving, presumptively sufficient airflow is being ram inducted through ducting conduit 20. In this dynamic state, the fan blades 4 may be folded back under a couple conditions. First, when the motor 6 is deactivated, since there is no longer a centrifugal force exerted on the plurality of blades 4 from the rotational movement imparted by the motor 6, the spring 18 returns to its open state, and therefore, forces the fan blades 4 to the folded non-deployed state. Second, the force of the incoming ram air may overcome the centrifugal force exerted on the fan blades 4, and therefore, force the fan blades 4 back into the folded non-deployed state.

Moreover, although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects.

Although the invention has been described with reference to particular means, materials and embodiments, the invention is not intended to be limited to the particulars disclosed; rather, the invention extends to all functionally equivalent structures, methods, and uses such are within the scope of the appended claims.

What is claimed is:

1. A low drag fan assembly adapted to be mounted within a ducting conduit of ram air induction system of a vehicle for cooling a heat exchanger, said low drag fan assembly comprising:

a motor having an output drive;

a motor bracketing system attached to said motor for suspending said motor within the ducting conduit of the ram air induction system;

a fan hub attached to said output drive;

a plurality of foldable fan blades hingedly attached to an outer perimeter of said fan hub;

wherein when said motor is not activated, said plurality of fan blades are folded back in a non-deployed state which is in a generally longitudinally congruent orientation with respect to the ducting conduit of the ram air induction system;

wherein when said motor is activated, said plurality of fan blades extend to a deployed state in which said plurality of blades are transversely oriented and positioned normal to the air flow path direction of the ducting conduit of the ram air induction system.

2. The assembly according to claim 1, wherein when said motor is inactive said plurality of fan blades are held in the non-deployed state by a force from a spring.

3. The assembly according to claim 2, wherein when said motor is activated, said plurality of fan blades extend to the deployed state when a centrifugal force imparted on said plurality of fan blades by the rotation of said motor exceeds the spring force which holds said plurality of fan blades in the non-deployed state.

4. The assembly according to claim 3, wherein when the force exerted on said plurality of fans blades by the airflow exceeds the centrifugal force imparted on said plurality of fan blades, said plurality of fan blades fold back to the non-deployed state.

5. The assembly according to claim 1, wherein each of said plurality of fan blades is attached to said fan hub by a foldable hinge.

6. The assembly according to claim 5, wherein said foldable hinge provides a mechanical stop which engages of portion of said fan blade when said fan blade is extended to a fully-deployed position.

7. The assembly according to claim 6, wherein a pitch of said plurality of fan blades assists in extending said plurality of fan blades to the fully-deployed state.

8. A low drag fan assembly in combination with a ram air induction system of a vehicle for cooling a heat exchanger, comprising:

a ram air induction system having a ducting conduit with a centerline axis; and a low drag fan assembly comprising:

a motor having an output drive;

a motor bracketing system attached to said motor for suspending said motor within said ducting conduit about the centerline axis;

a fan hub attached to said output drive; and a plurality of foldable fan blades hingedly attached to an outer perimeter of said fan hub;

wherein when said motor is not activated, said plurality of fan blades are folded back in a non-deployed state which is generally longitudinally congruent to the centerline axis; and wherein when said motor is activated, said plurality of fan blades extend to a deployed state generally normal to the centerline axis.

9. The assembly in combination with said ram air induction system according to claim 8, further comprising a heat exchanger transversely positioned within said ducting conduit beyond said low drag fan assembly.

10. The assembly in combination with said ram air induction system according to claim 8, wherein when said motor is inactive, said plurality of fan blades are held in the non-deployed state by a spring force.

11. The assembly in combination with said ram air induction system according to claim 10, wherein when said motor is activated, said fan hub and said plurality of fans rotate about the centerline axis.

12. The assembly in combination with said ram air induction system according to claim 11, wherein said plurality of fan blades extend to the deployed state when a centrifugal force imparted on said plurality of fan blades exceeds the spring force which holds said plurality of fan blades in the non-deployed state.

13. The assembly in combination with said ram air induction system according to claim 12, wherein when the force exerted on said plurality of fans blades by the airflow exceeds the centrifugal force imparted on said plurality of fan blades by the rotation of said motor, the plurality of said fan blades fold back to the non-deployed state.

14. The assembly in combination with said ram air induction system according to claim 8, wherein each of said plurality of fan blades is attached to said fan hub by a foldable hinge.

15. The assembly in combination with said ram air induction system according to claim 14, wherein said foldable hinge provides a mechanical stop which engages of portion of said fan blade when said fan blade is extended to a fully-deployed position.

16. The assembly in combination with said ram air induction system according to claim 8, wherein a pitch of said plurality of fan blades assists in extending said plurality of fan blades to the fully-deployed state.

17. The assembly in combination with said ram air induction system according to claim 8, wherein the vehicle comprises one of an aircraft, spacecraft, ocean vessel, or land conveyance vehicle.

* * * * *